US012317990B2

(12) United States Patent
Yang

(10) Patent No.: US 12,317,990 B2
(45) Date of Patent: Jun. 3, 2025

(54) FOLDABLE HAMMOCK

(71) Applicant: Zhejiang Hengfeng Top Leisure Co., Ltd., Zhejiang (CN)

(72) Inventor: Baoqing Yang, HangZhou (CN)

(73) Assignee: Zhejiang Hengfeng Top Leisure Co., Ltd., Zhejiang (CN)

( * ) Notice: Subject to any disclaimer, the term of this patent is extended or adjusted under 35 U.S.C. 154(b) by 362 days.

(21) Appl. No.: 17/994,562

(22) Filed: Nov. 28, 2022

(65) Prior Publication Data

US 2024/0172861 A1 May 30, 2024

(51) Int. Cl.
*A45F 3/24* (2006.01)

(52) U.S. Cl.
CPC ..... *A45F 3/24* (2013.01)

(58) Field of Classification Search
CPC ..... A45F 3/22; A45F 3/24; A45F 3/26; A45F 4/08
See application file for complete search history.

(56) References Cited

U.S. PATENT DOCUMENTS

| | | | | |
|---|---|---|---|---|
| 381,025 | A * | 4/1888 | Parmelee | A45F 3/24 135/96 |
| 1,788,919 | A * | 1/1931 | Lansberry | A47C 19/122 5/115 |
| 5,392,476 | A * | 2/1995 | Williams | A45F 3/24 5/127 |
| 6,912,744 | B2 | 7/2005 | Lyons | |
| 7,089,610 | B2 * | 8/2006 | Zhong | A45F 3/24 5/127 |
| 7,406,726 | B2 | 8/2008 | Deng | |
| 7,895,686 | B1 * | 3/2011 | Chen | A47C 17/64 5/120 |
| 7,996,935 | B1 | 8/2011 | Chen | |
| 8,214,946 | B2 * | 7/2012 | Reeb | A45F 3/24 5/127 |
| 8,806,676 | B2 | 8/2014 | Reeb et al. | |
| 10,455,942 | B2 | 10/2019 | Chen et al. | |
| 2006/0282948 | A1 * | 12/2006 | Deng | A45F 3/24 5/127 |
| 2011/0231992 | A1 * | 9/2011 | Bernat | A45F 3/24 5/127 |

FOREIGN PATENT DOCUMENTS

| | | | |
|---|---|---|---|
| CN | 215014378 | U | 12/2021 |

* cited by examiner

*Primary Examiner* — George Sun
(74) *Attorney, Agent, or Firm* — Thompson Coburn LLP

(57) ABSTRACT

A hammock has a foldable frame. The frame includes two connecting rod assemblies located on lateral sides of the hammock and connected to each other. Each connecting rod assembly comprises first, second, third, fourth, fifth and sixth rods. Tops of the first and second rods are rotatably connected. Bottoms of the third and fourth rods are rotatably connected. The first rod is rotatably connected with the third rod and the second rod is rotatably connected with the fourth rod. A bottom of the first rod is rotatably connected with a bottom of the fifth rod, and a bottom of the second rod is rotatably connected with a bottom of the sixth rod. The fifth and sixth rods each have a positioning groove. Connecting rods rotatably connected to the tops of the third and fourth rods are releasably engageable with the respective positioning groove.

17 Claims, 7 Drawing Sheets

FOLDABLE HAMMOCK

FIELD

The present application relates to the technical field of hammocks, and in particular to a hammock frame and a hammock having the same.

BACKGROUND

A hammock generally can be folded, and is often used in outdoor tourism, courtyard leisure, outdoor camping and other occasions. Therefore, it is increasingly popular among users.

The existing hammock is bulky after being folded and is also heavy, so that the packaging cost and transportation cost of products are high, and the existing hammock is not convenient to carry outdoors, adversely affecting the user experience.

Therefore, how to provide a hammock which is small in volume after folding and convenient to carry is a technical problem that the person skilled in this art needs to think about.

SUMMARY

An object according to the present application is to provide a hammock frame and a hammock having the same, and the hammock is small in volume after folding and convenient to carry.

To achieve the above object, a hammock frame is provided according to the present application, which includes two sets of connecting rod assemblies located on opposite lateral sides of the frame. Each of the connecting rod assemblies is connected to each other to define the hammock frame. Each connecting rod assembly includes a first rod, a second rod, a third rod, a fourth rod, a fifth rod and a sixth rod, where:

- the top of the first rod is rotatably connected with the top of the second rod, the bottom of the third rod is rotatably connected with the bottom of the fourth rod, the first rod is rotatably connected with the third rod, the second rod is rotatably connected with the fourth rod, the top connection shared by the first rod and the second rod is located vertically above the bottom connection shared by the third rod and the fourth rod;
- the bottom of the first rod is rotatably connected with the bottom of the fifth rod, the bottom of the second rod is rotatably connected with the bottom of the sixth rod;
- a first positioning groove member is provided on the fifth rod, and a second positioning groove member is provided on the sixth rod;
- a first connecting rod is rotatably connected to the top of the third rod, the first connecting rod is snapped and fixed into a groove body of the first positioning groove member, the second connecting rod is rotatably connected to the top of the fourth rod, and the second connecting rod is snapped and fixed into a groove body of the second positioning groove member.

Compared with the above background technology, the hammock frame shown in the embodiments of the present application includes two connecting rod assemblies on lateral sides of the hammock frame where in each connecting rod assembly, the top of the first rod is rotatably connected with the top of the second rod, the bottom of the third rod is rotatably connected with the bottom of the fourth rod, and the first rod is rotatably connected with the third rod, so that the first rod, the second rod, the third rod and the fourth rod are connected to present a double cross rod structure. Moreover, the bottom of the first rod is rotatably connected with the bottom of the fifth rod, and the bottom of the second rod is rotatably connected with the bottom of the sixth rod. Accordingly, in the expanded configuration of the hammock frame, the first rod, the second rod, the fifth rod and the sixth rod are connected to present a "W" shape, and the third rod and the fourth rod are connected to present a "V" shape. In this way, the volume of the hammock frame can be greatly reduced during folding, thus ensuring convenient handling. Meanwhile, compared to sliding structures existing in conventional technology (such as the case where the third rod slides on the fifth rod, and the third rod and the fifth rod need to be unlocked and locked), the hammock frame provided by the embodiments of the present application can be folded and unfolded by rotation, which is easy to operate, and there is no need to unlock the position of the third rod and the fifth rod when sliding.

In an embodiment, a traverse brace member is detachably provided between the tops of the two fifth rods and/or the tops of the two sixth rods.

In an embodiment, each fifth rod and each sixth rod extend outward from bottom to top.

In an embodiment, each connecting rod assembly further includes a sun shade with an adjusting member and a supporting member arranged at the top of the fifth rod. The bottom of the adjusting member and/or the supporting member is rotatably connected to the fifth rod. The height of the adjusting member can be adjusted, so as to adjust the shading angle. The top of the adjusting member and the top of the supporting member are rotatably connected with a ceiling member, and a sleeve member is slidably connected in the ceiling member. The ceiling member and the sleeve member extend toward the sixth rod when the sun shade is deployed with the hammock frame in the expanded position so that the shading area can be adjusted by sliding the sleeve member relative to the ceiling member. In an embodiment, a supporting bar is arranged between the two sleeve members when the sun shade is deployed with the hammock frame in the expanded position. The sunshade can be folded, which is convenient to carry and store.

In an embodiment, a front cross member assembly and a rear cross member assembly are arranged between the two groups of connecting rod assemblies. Each cross member assembly includes a first cross member and a second cross member that are rotatably connected. The bottoms of the first cross member and the second cross member of the front cross member assembly are respectively operatively rotatably connected adjacent to the bottoms of the first rod and the fifth rod and may be connected to an adjacent a foot pad. The tops of the first cross member and second cross member of the front cross member assembly are respectively operatively rotatably connected to joints of the third rod. The bottoms of the first cross member and the second cross member in the rear cross member assembly are respectively operatively rotatably connected adjacent to the bottoms of the second rod and the sixth rod, and may be connected to an adjacent foot pad. The tops of the first cross member and the second cross member of the rear cross member assembly are respectively operatively rotatably connected to joints of the fourth rod.

In an embodiment, the two groups of connecting rod assemblies are symmetrically arranged. The first rod, the third rod, the first connecting rod and the fifth rod in one group of the connecting rod assembly are symmetrically arranged with the second rod, the fourth rod, the second connecting rod and the sixth rod within each connecting rod assembly and from one connecting rod assembly to the laterally opposite connecting rod assembly.

A hammock provided by the embodiments of the present application includes the above hammock frame.

BRIEF DESCRIPTION OF THE DRAWINGS

For more clearly illustrating embodiments of the present application or the technical solutions in the conventional technology, drawings referred to for describing the embodiments or the conventional technology will be briefly described hereinafter. Apparently, the drawings in the following description are only examples of the present application, and for the person skilled in the art, other drawings may be obtained based on the drawings provided without any creative efforts.

Figure 1:
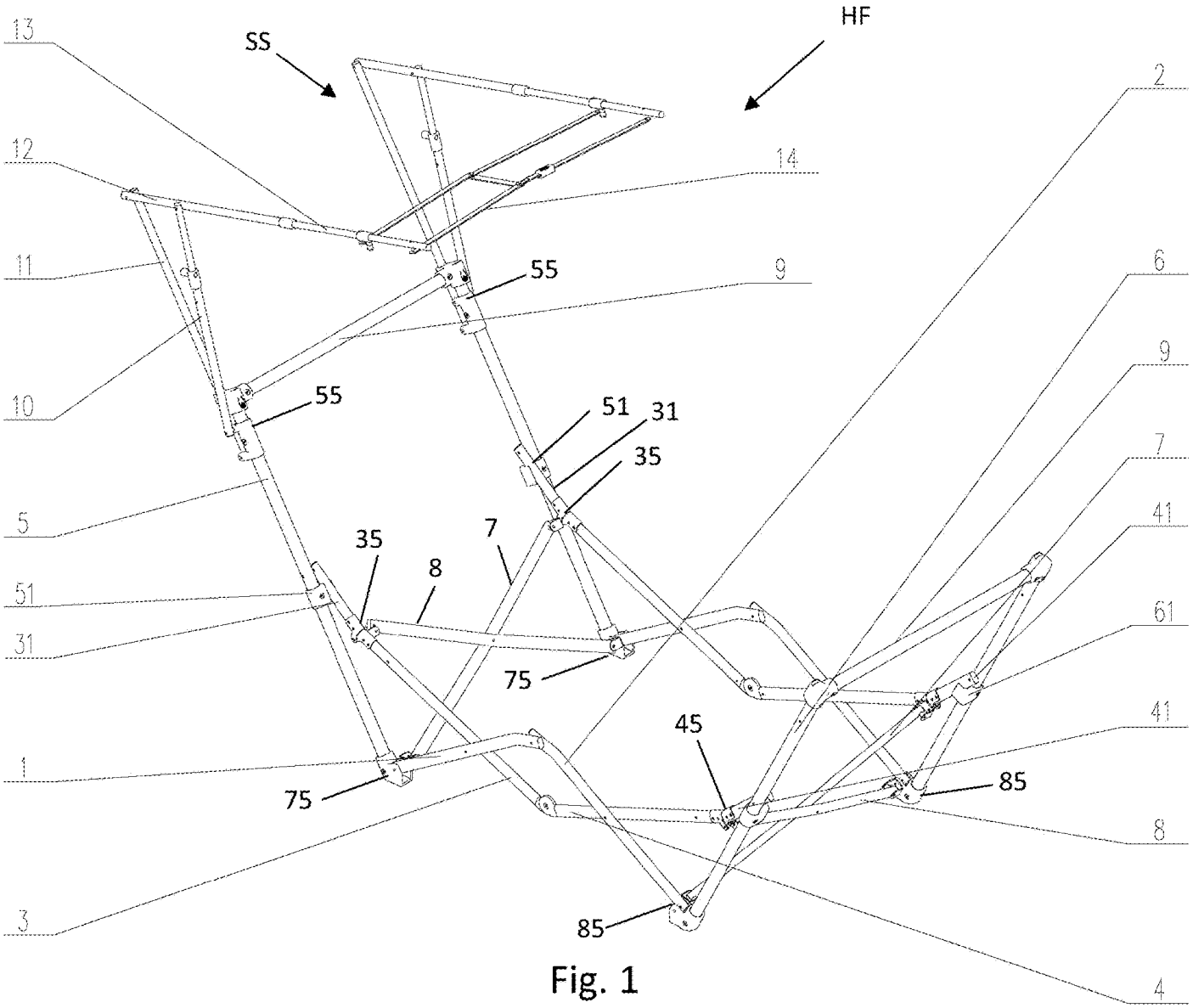
FIG. 1 is a schematic view of a hammock frame provided by an embodiment of the present application.
Figure 2:
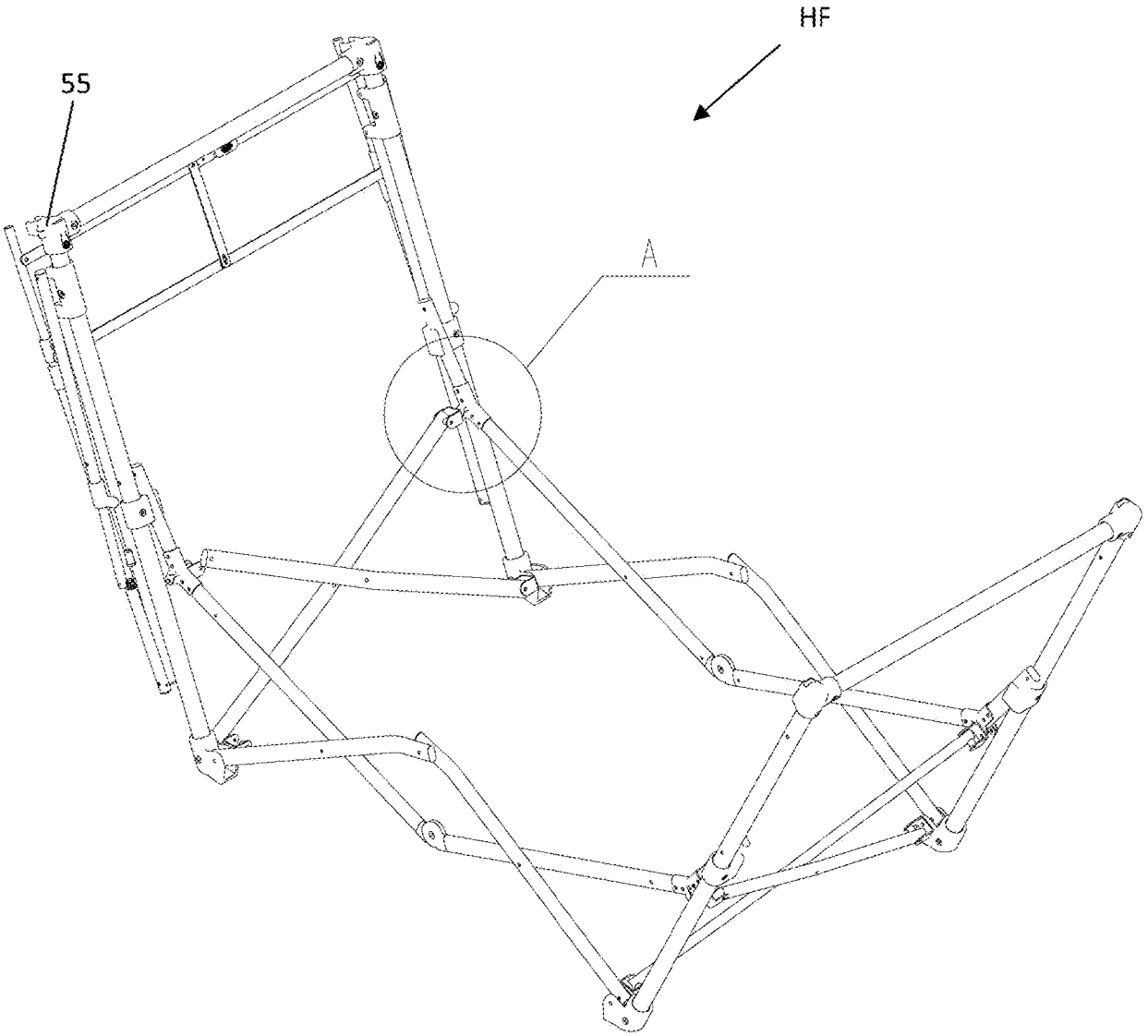
FIG. 2 is a schematic view of the hammock frame provided by the embodiment of the present application when the sunshade is folded.
Figure 3:
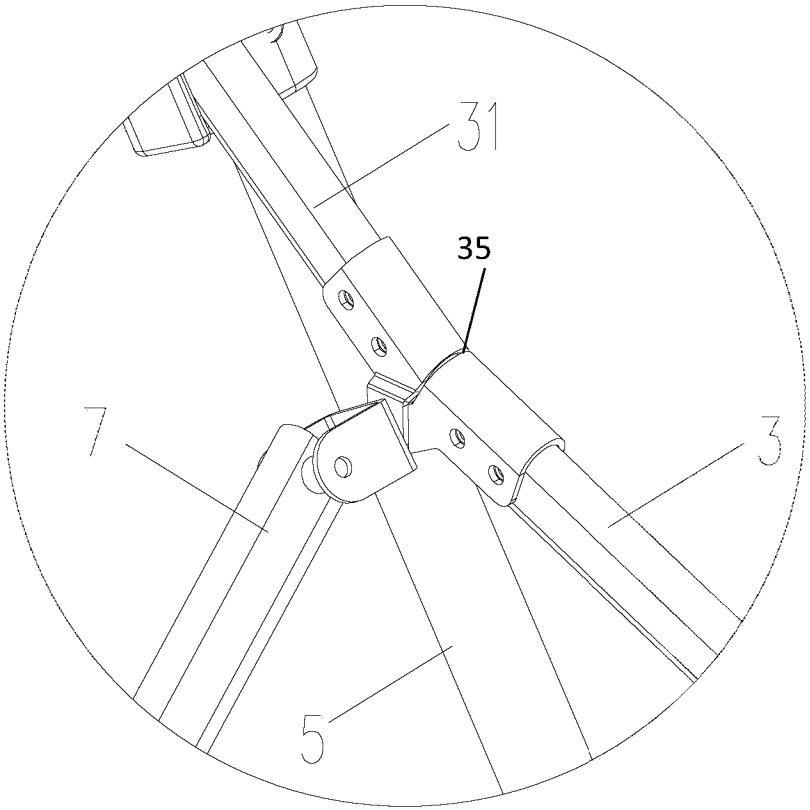
FIG. 3 is a schematic enlarged view of portion A in FIG. 2.

where reference numerals in the drawings are listed as follows:

1 first rod, 2 second rod, 3 third rod, 31 first connecting rod, 4 fourth rod, 41 second connecting rod, 5 fifth rod, 51 first positioning groove, 6 sixth rod, 61 second positioning groove, 7 first crossing member, 8 second crossing member, 9 traverse brace member, 10 adjusting member, 11 supporting member, 12 ceiling member, 13 sleeve member, 14 supporting bar.

DETAILED DESCRIPTION OF THE EMBODIMENTS

The technical solutions in the embodiments of the present application will be described clearly and completely as follows in conjunction with the drawings in the embodiments of the present application. It is apparent that the described embodiments are only a part of the embodiments according to the present application, rather than all of the embodiments. Based on the embodiments in the present application, all of other embodiments, made by the person skilled in the art without any creative efforts, fall into the scope of protection of the present application.

In order to provide the person skilled in the art with a better understanding of the solution of the present application, the present application is described hereinafter in further detail in conjunction with the drawings and embodiments.

The hammock frame (HF) provided by the embodiments of the present application is shown in FIG. 1 to FIG. 7 of the specification, including two groups of connecting rod assemblies which are respectively located at two sides and connected with each other, where the two groups of connecting rod assemblies can approach and move away from each other, so as to realize folding and unfolding.

Each group of connecting rod assemblies includes a first rod 1, a second rod 2, a third rod 3, a fourth rod 4, a fifth rod 5 and a sixth rod 6. The top of the first rod 1 is rotatably connected with the top of the second rod 2, and the first rod 1 and the second rod 2 can be symmetrically arranged. In the expanded configuration of the frame, the first rod 1 and the second rod 2 form an inverted V-shape.

The bottom of the fifth rod 5 may be rotatably connected with the bottom of the first rod 1, the bottom of the sixth rod 6 may be rotatably connected with the bottom of the second rod 2. In the expanded configuration of the frame, the fifth rod 5 and the sixth rod 6 extend outward from bottom to top, that is, the first rod 1, the second rod 2, the fifth rod 5 and the sixth rod 6 may be connected to form a W shape, and can be symmetrically arranged.

The bottom of the third rod 3 may be rotatably connected with the bottom of the fourth rod 4. In the expanded configuration of the frame, the third rod 3 and the fourth rod 4 form a V shape and can be symmetrically arranged. The middle part of the third rod 3 may be rotatably connected with the middle part of the first rod 1, the middle part of the fourth rod 4 may be rotatably connected with the middle part of the second rod 2. The top connection shared by the first rod 1 and the second rod 2 may be located vertically above the bottom connection shared by the third rod 3 and the fourth rod 4. In this way, the first rod 1, the second rod 2, the third rod 3, the fourth rod 4, the fifth rod 5 and the sixth rod 6 can be unfolded and folded synchronously.

A first positioning groove 51 may be provided on the fifth rod 5, and a second positioning groove 61 may be provided on the sixth rod 6. The first positioning groove 51 can be a metal pipe fitting, and may include a clamp sleeved on the fifth rod 5 with an integral groove body for supporting a first connecting rod 31. The integral groove body may be located lateral inward or toward the inside of the fifth rod 5.

Similarly, the second positioning groove 61 may include a clamp sleeved on the sixth rod 6 with an integral groove body for supporting the second connecting rod 41. The integral groove body may be located laterally inward or toward the inside of the sixth rod 6.

A first connecting rod 31 has one end rotatably connected to the top of the third rod 3 at a joint 35 and an opposite end rotatably connected to the fifth rod 5. A second connecting rod 41 has one end rotatably connected to the top of the fourth rod 4 at a joint 45, and an opposite end rotatably connected to the sixth rod 6. The first connecting rod 31 and the second connecting rod 41 may be symmetrically arranged on the hammock frame (HF).

When the hammock frame (HF) is in the unfolded or expanded state, the first connecting rod 31 is snapped and fixed into the first positioning groove 51, and the second connecting rod 41 is snapped and fixed into the second positioning groove 61.

It can be seen that, the first positioning groove 51 and the second positioning groove 61 limit the first connecting rod 31 and the second connecting rod 41, and prevent the first connecting rod 31 and the second connecting rod 41 from moving beyond the limit position.

FIG. 1 shows a schematic view of the hammock frame (HF) in an unfolded or expanded state. It can be seen that the third rod 3 and the first connecting rod 31 are in a straight line and can be regarded as a straight rod. The joint 35 between the third rod 3 and the first connecting rod 31 comprises a rotating connecting piece with a pivot connection located below the rods 3,31. In this configuration, an end of the first connecting rod 31 abuts against an end of the third rod 3 in a manner such that the first connecting rod 31 cannot rotate clockwise relative to the third rod 3. That is, in the expanded configuration of the frame shown in FIG. 1, the orientation of the rotating connecting piece of the joint 35 is such that it limits the position of the third rod 3 and the first connecting rod 31. When the position of the first connecting rod 31 is fixed by the first positioning groove 51, the positions of the third rod 3, the first connecting rod 31 and the fifth rod 5 are fixed. The joint 45 is similar so in a similar fashion, the positions of the fourth rod 4, the second connecting rod 41 and the sixth rod 6 are fixed when the second connecting rod is fixed by the second positioning groove 61.

Figure 5:
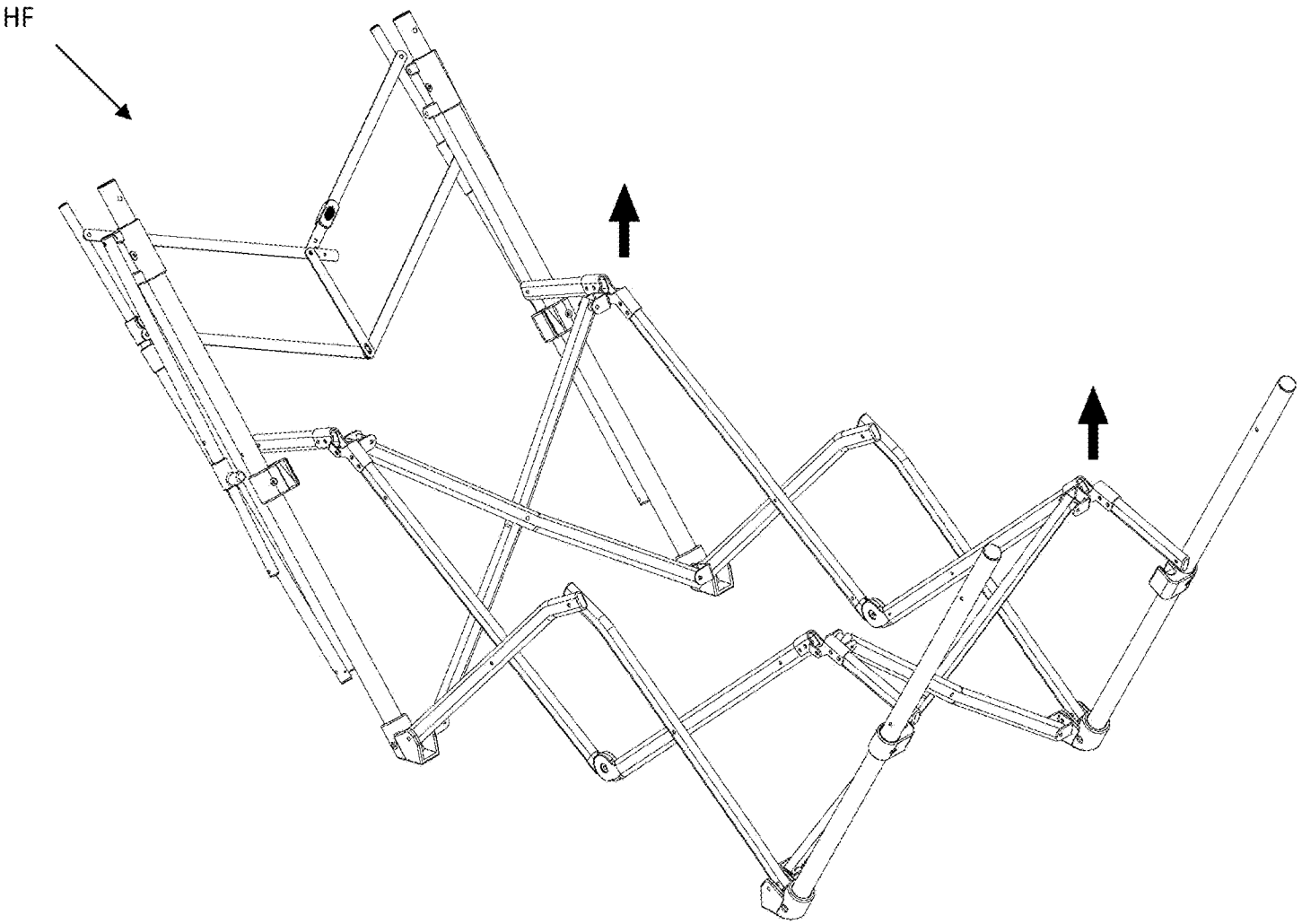
FIG. 5 is a schematic view of the hammock frame provided by the embodiment of the present application when it is being folded as a whole.
Figure 6:
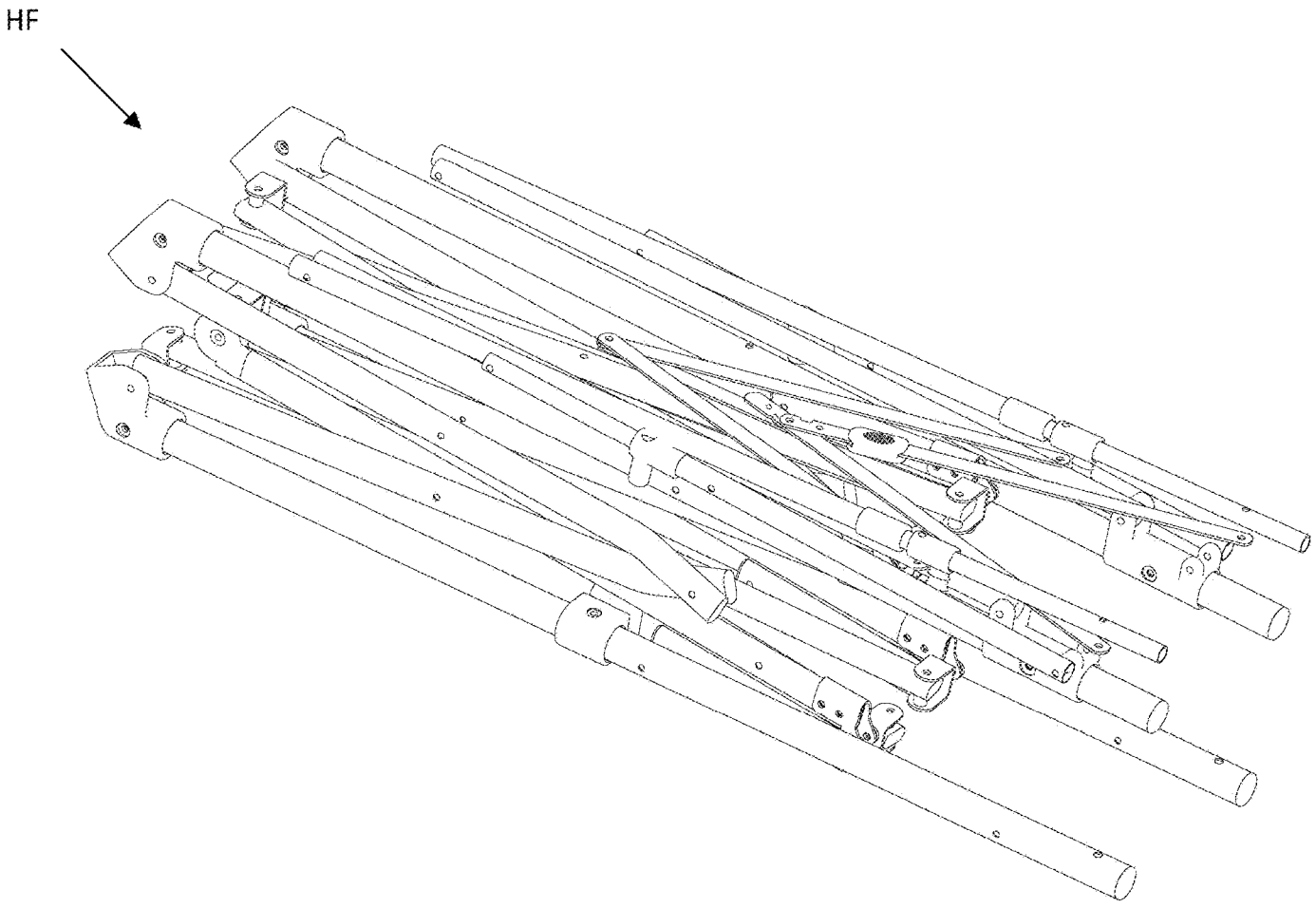
FIG. 6 is a schematic view of the hammock frame provided by the embodiment of the present application after it has been folded as a whole.
Figure 7:
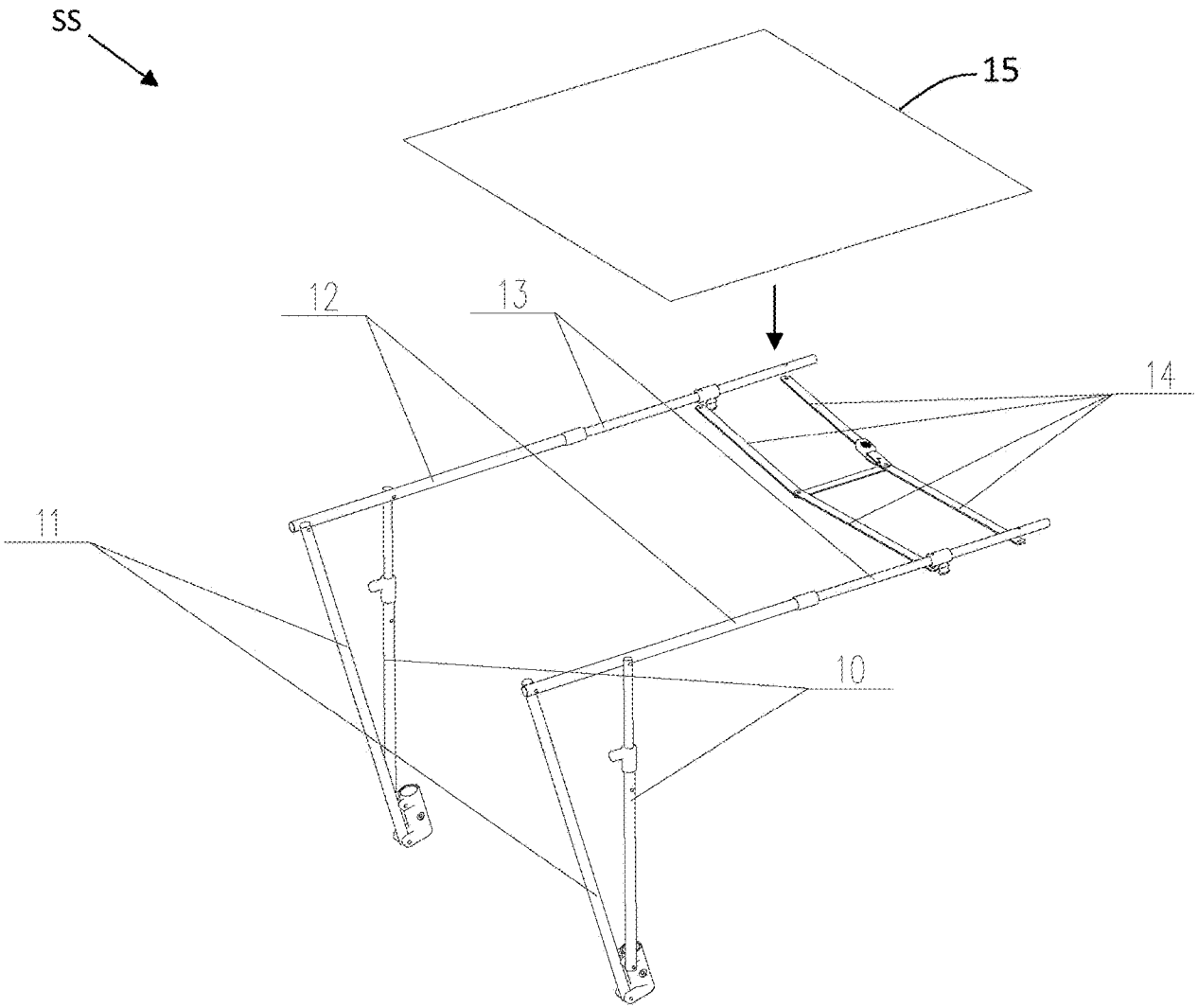
FIG. 7 is a schematic view of the sunshade of the hammock frame provided by the embodiment of the present application.

When folding is required, referring to FIG. 5 of the specification, the hammock frame (HF) is moved in the direction of the arrows in FIG. 5, so that the angle between the first rod 1 and the second rod 2 is becomes smaller. Likewise, the angle between the third rod 3 and the fourth rod 4 becomes smaller. The first connecting rod 31 is rotated out of and relative to the first positioning groove 51. When the first connecting rod 31 is separated from the first positioning groove 51, the first connecting rod 31 can rotate counterclockwise relative to the third rod 3 via the joint 35, thereby folding the first connecting 31 and the third rod 3. The second connecting rod 41 is rotated out of and relative to the second positioning groove 61. When the second connecting rod 41 is separated from the second positioning groove 61, the second connecting rod 41 can rotate counterclockwise relative to the fourth rod 4 via the joint 45, thereby folding the second connecting 41 and the fourth rod 4.

In order to fix the position between the two groups of connecting rod assemblies, a traverse brace member 9 can be arranged between the tops of the two fifth rods 5 of the connection rod assemblies and/or the tops of the two sixth rods 6 of the connection rod assemblies. The traverse brace member 9 may be detachable relative to the fifth rods 5 and/or sixth rods 6. The tops of the two fifth rods 5 of the connection rod assemblies and/or the tops of the two sixth rods 6 of the connection rod assemblies may have sockets adapted to receive an end of the transverse brace member 9. Accordingly one or two traverse brace members 9 may be provided with the hammock frame (HF).

In order to realize the shading effect, each group of connecting rod assemblies may further include an sun shade (SS). The sunshade (SS) may include an adjusting member 10 and a supporting member 11. The bottoms of the adjusting member 10 and the supporting member 11 may be arranged at the top of the fifth rod 5. The height of the adjusting member 10 may be adjustable. The top of the adjusting member 10 and the top of the supporting member 11 may be rotatably connected with a ceiling member 12, and a sleeve member 13 may be slidably connected to the ceiling member 12, for instance, telescopically.

The adjusting member 10 may be provided with multiple levels of height for adjustment, for example, the adjusting member 10 may be arranged as two sleeves telescopically nested with each other and adjustably fixable relative to each other. In one aspect, the outer sleeve may be provided with multiple holes, and the inner sleeve may be provided with one a hole. The sleeves may be adjusted so that the hole of the inner sleeve comes into register with a desired hole of the different holes of the outer sleeve, and a pin or screw may be inserted into two holes to fix the height of the adjusting member 10. In another aspect, a spring loaded protrusion extending out of the inner sleeve may be engageable with a desired hole of the different holes of the outer sleeve. The ceiling member 12 and the sleeve member 13 may be arranged to rotate around the top of the supporting member 11, so as to adjust the shading angle. For at the nesting mode of the two sleeves, it is also possible to adopt a fitting mode such as the engagement of a spring pin with a groove, and the spring pin is inserted into the groove to fix the two sleeves, and when the two sleeves need to be separated, the spring pin can be detached from the groove. Furthermore, the shading area can be adjusted by the sliding of the sleeve member 13 relative to the ceiling member 12. The sleeve member and ceiling member may have an arrangement similar to the adjusting member that allows the sleeve member and the ceiling member to be adjustably fixable relative to each other.

Figure 4:
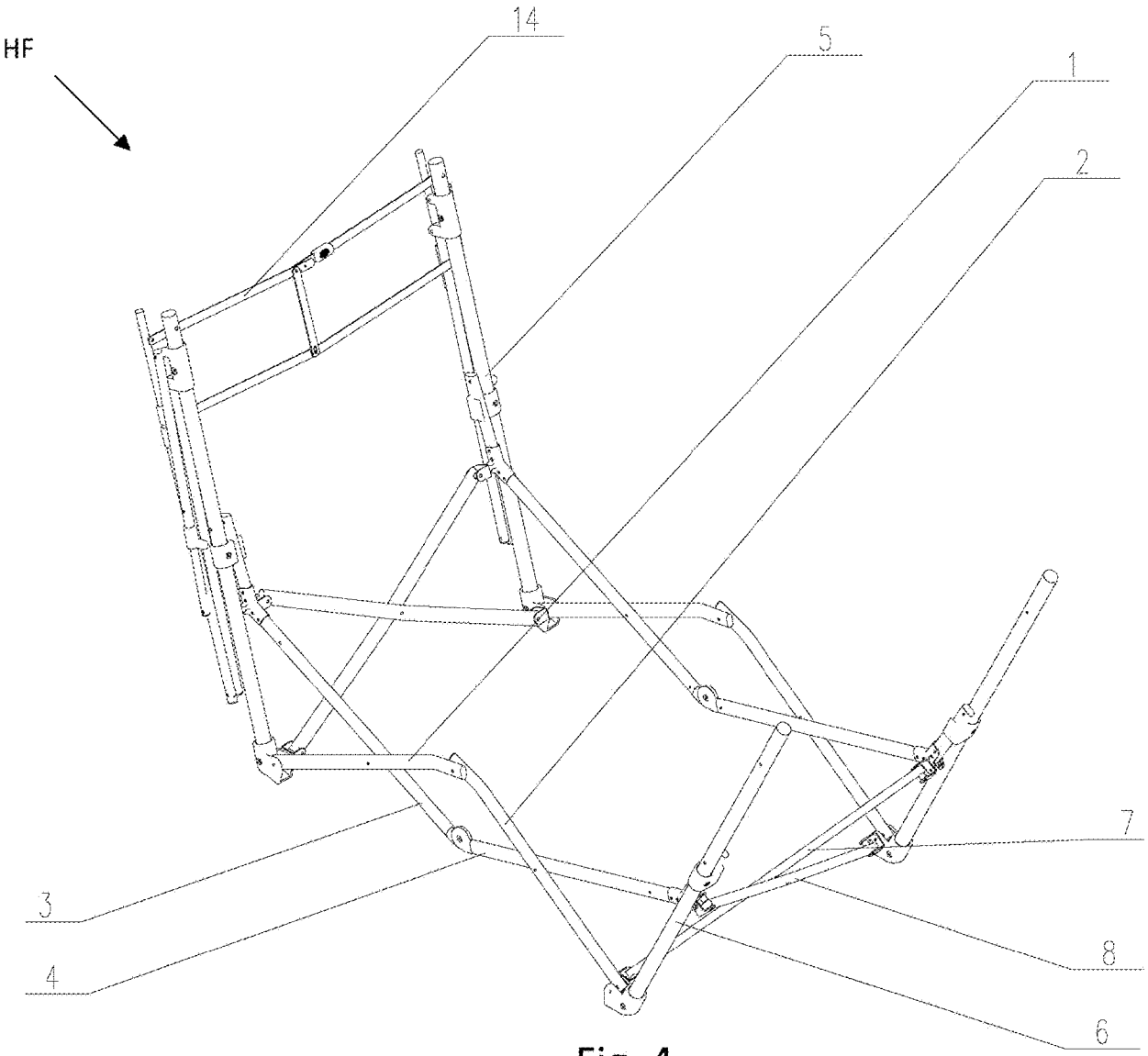
FIG. 4 is a schematic view of the hammock frame provided by the embodiment of the present application when two traverse brace members are removed.

The sunshade (SS) may also include a supporting bar 14 arranged between the two sleeve members 13, so that the position between the two sleeve members 13 is fixed, thereby realizing a reliable shading effect. The number of the supporting bar 14 can be four, and the four supporting bars 14 are collinear in pairs, two supporting bars 14 collinearly arranged are rotatably connected, and all four supporting bars 14 are rotatably connected to the sleeve members 13, as shown in FIG. 1 of the specification; when folding, the parallelogram structure formed by the four supporting bars 14 and the two sleeve members 13 may be folded downward, as shown in FIG. 4.

The bottoms of the adjusting member 10 and the supporting member 11 may be rotatably connected to the top of the fifth rod 5, so as to further adjust the shading angle. The adjusting member 10 and the supporting member 11 may be mounted on the fifth rod 5, which is convenient to carry and store. When the sunshade is folded, the sunshade may also be temporarily fixed to the fifth rod 5 with a strap.

The ceiling member 12 and the sleeve member 13 extend toward the sixth rod 6. Taking the orientation shown in FIG. 1 as an example, the ceiling member 12 and the sleeve member 13 both extend to the right side where most of the hammock frame (HF) is located. A shade cloth 15 may be provided on the ceiling member 12 and the sleeve member 13. The shade cloth 15 can hang over the user, which is conducive to improving the shielding effect.

When the hammock frame (HF) to be folded, the sunshade is folded first by removing the supporting member 11 from a buckle 55 at the top of the fifth rod 5, and pivoting the adjustment member 10, ceiling member 12, and sleeve member behind the fifth rod, so the supporting member 11, adjusting member 10, the ceiling member 12, and sleeve member 13 may be adjacent and aligned generally parallel to each other with the fifth rod 5. In this way, the occupied area of the sunshade part can be reduced.

The front and rear cross member assemblies may each include first cross members 7 and second cross members 8 may be arranged between the two groups of connecting rod assemblies. In the front cross member assembly, the first cross member pipe 7 and the second cross member 8 may be arranged crosswise and may be rotatably connected at their centers. The top ends of the first and second cross members 7,8 of the front cross member assembly may be operatively rotatably connected to the second rods 2 or respective joints 35 of the connecting rod assemblies. The bottom ends of the first and second cross members 7,8 of the front cross member assembly may be operatively rotatably connected to adjacent to the bottom of the fifth rods 5 and/or adjacent bottoms of the first rods 1, and/or a foot pad. In the rear cross member assembly, the first cross member pipe 7 and the second cross member 8 may be arranged crosswise and may be rotatably connected at their centers. The top ends of the first and second cross members 7,8 of the rear cross member assembly may be operatively rotatably connected to the fourth rods 4 or respective joints 45 of the connecting rod assemblies. The bottom ends of the first and second cross members 7,8 of the front cross member assembly may be operatively rotatably connected to adjacent to the bottom of the sixth rods 6 and/or adjacent bottoms of the second rods 2, and/or a foot pad.

Four foot pads 75,85 may be provided. Two of the foot pads may be operatively rotatably connected with the first rods 1 and the fifth rods 5, which can be called front foot pads 75, and the other two foot pads may be operatively rotatably connected with the second rods 2 and the sixth rods 6, which can be called rear foot pads 85. The bottom of the first cross member 7 and the bottom of the second cross member 8 of the front cross member assembly may be respectively hinged to different front foot pads 75. The bottom of the first cross member 7 and the bottom second cross member 8 of the front cross member assembly may be respectively hinged to different rear foot pads 85.

Four joints 35,45 with rotating connecting pieces may be provided. Two joints 35 with rotating connecting pieces may be used to connect the third rod 3 and the first connecting rod 31, which can be called front rotating connecting pieces, and two joints 45 with rotating connecting pieces may be used to connect the fourth rod 4 and the second connecting rod 41, which can be called rear rotating connecting pieces. The tops of the first cross member 7 and the second cross member 8 can be hinged to different front rotating connecting pieces, respectively.

A hammock with a hammock frame is provided according to the present application, which includes the hammock frame described in the specific embodiments. The hammock may further include cloth and the like arranged on the hammock frame, and other parts of the hammock can refer to the conventional technology, which will not be described in detail here.

It should be noted that, relationship terms herein such as first and second are merely used to distinguish an entity from other entities and do not require or imply that there are any such actual relationships or sequences between these entities.

The hammock frame provided by the present application and the hammock having the same are introduced in detail. The principle and embodiments of the present application are described through specific examples herein. The description of the above-described embodiments is merely used to facilitate understanding the method and core idea of the present application. It should be noted that, for those skilled in the art, various improvements and modifications may be further made to the present application without departing from the principle of the present application, and these improvements and modifications also fall within the protection scope defined by the claims of the present application.

The invention claimed is:

1. A hammock comprising a frame, the frame being movable between an expanded configuration and a folded configuration, the frame comprising:

two sets of connecting rod assemblies located on opposite lateral sides of the frame and connected to each other, each connecting rod assembly comprising a first rod, a second rod, a third rod, a fourth rod, a fifth rod, and a sixth rod, wherein in each connecting rod assembly:

a top of the first rod is rotatably connected with a top of the second rod, a bottom of the third rod is rotatably connected with a bottom of the fourth rod, the first rod is rotatably connected with the third rod, the second rod is rotatably connected with the fourth rod, a connection of the top of the first rod with the top of the second rod is located above a connection of the bottom of the third rod with the bottom of the fourth rod;

a bottom of the first rod is operatively rotatably connected with a bottom of the fifth rod, a bottom of the second rod is operatively rotatably connected with a bottom of the sixth rod;

a first connecting rod has one end operatively rotatably connected to the fifth rod and another end operatively rotatably connected to a top of the third rod; and a second connecting rod has one end operatively rotatably connected with a sixth rod and another end operatively rotatably connected to a top of the fourth rod; and a transverse brace rod detachably connectable between at least one of tops of the fifth rods of each of the connecting rod assemblies, and tops of the sixth rods of each of the connecting rod assemblies.

2. The hammock according to claim 1, wherein each fifth rod and each sixth rod extend outward from bottom to top when the frame is in the expanded configuration.

3. The hammock according to claim 1, wherein the frame comprises front and rear cross member assemblies arranged between the connecting rod assemblies, the front cross member assembly comprising a first cross member and a second cross member rotatably connected to each other, the rear cross member assembly comprising a first cross member and a second cross member rotatably connected to each other.

4. The hammock according to claim 3, wherein a top of the first cross member of the front cross member assembly and a top of the second cross member of the front cross member assembly are operatively rotatably connected to the third rods of the respective connecting rod assemblies, and a top of the first cross member of the rear cross member assembly and a top of the second cross member of the rear cross member assembly are operatively rotatably connected to the fourth rods of the respective connecting rod assemblies.

5. The hammock according to claim 3, wherein a bottom of the first cross member of the front cross member assembly and a bottom of the second cross member of the front cross member assembly are operatively rotatably connected adjacent to bottoms of the fifth rods of the respective connecting rod assemblies, and a bottom of the first cross member of the rear cross member assembly and a bottom of the second cross member of the rear cross member assembly are operatively rotatably connected adjacent to bottoms of the sixth rods of the respective connecting rod assemblies.

6. The hammock according to claim 3, wherein a bottom of the first cross member of the front cross member assembly and a bottom of the second cross member of the front cross member assembly are operatively rotatably connected adjacent to bottoms of the first rods of the respective connecting rod assemblies, and a bottom of the first cross member of the rear cross member assembly and a bottom of the second cross member of the rear cross member assembly are operatively rotatably connected adjacent to bottoms of the seconds rods of the respective connecting rod assemblies.

7. The hammock according to claim 3, wherein a bottom of the first cross member of the front cross member assembly and a bottom of the second cross member of the front cross member assembly are operatively rotatably connected to front foot pads of the respective connecting rod assemblies, and a bottom of the first cross member of the rear cross member assembly and a bottom of the second cross member of the rear cross member assembly are operatively rotatably connected to rear foot pads of the respective connecting rod assemblies.

8. The hammock according to claim 3 wherein in each connecting rod assembly, the first connecting rod is rotatably connected to the top of the third rod with a joint having a rotary connector, and a top of the first cross member of the front cross member assembly and a top of the second cross member of the front cross member assembly are operatively rotatably connected to the joint of the respective connecting rod assemblies.

9. The hammock according to claim 3 wherein in each connecting rod assembly, the second connecting rod is rotatably connected to the top of the fourth rod with a joint having a rotary connector, and a top of the first cross member of the rear cross member assembly and a top of the second cross member of the rear cross member assembly are operatively rotatably connected to the joint of the respective connecting rod assemblies.

10. The hammock according to claim 1, wherein the two connecting rod assemblies are symmetrically arranged on the frame.

11. The hammock according to claim 1, wherein in at least one of the connecting rod assemblies, the first rod, the third rod, the first connecting rod and the fifth rod are symmetrically arranged with the second rod, the fourth rod, the second connecting rod, and the sixth rod.

12. A hammock comprising a frame, the frame being movable between an expanded configuration and a folded configuration, the frame comprising:

two sets of connecting rod assemblies located on opposite lateral sides of the frame and connected to each other, each connecting rod assembly comprising a first rod, a second rod, a third rod, a fourth rod, a fifth rod, and a sixth rod, wherein in each connecting rod assembly:

a top of the first rod is rotatably connected with a top of the second rod, a bottom of the third rod is rotatably connected with a bottom of the fourth rod, the first rod is rotatably connected with the third rod, the second rod is rotatably connected with the fourth rod, a connection of the top of the first rod with the top of the second rod is located above a connection of the bottom of the third rod with the bottom of the fourth rod;

a bottom of the first rod is operatively rotatably connected with a bottom of the fifth rod, a bottom of the second rod is operatively rotatably connected with a bottom of the sixth rod;

a first connecting rod has one end operatively rotatably connected to the fifth rod and another end operatively rotatably connected to a top of the third rod; and a second connecting rod has one end operatively rotatably connected with a sixth rod and another end operatively rotatably connected to a top of the fourth rod;

and a sunshade, wherein the sunshade comprises an adjusting member and a supporting member each arranged at the top of the fifth rods, a length of the adjusting member being adjustable, a top of the adjusting member and a top of the supporting member being rotatably connected with a ceiling member, the ceiling member supporting a shade member of the sun shade.

13. The hammock according to claim 12 wherein the sunshade comprises a sleeve member telescopically arranged with the ceiling member.

14. The hammock according to claim 13 wherein when the frame is in the expanded configuration and the sunshade is deployed, the ceiling member and the sleeve member extend toward the sixth rod of the respective connecting rod assembly.

15. The hammock according to claim 12, wherein the sunshade comprises a supporting bar is arranged between the sleeve members.

16. The hammock according to claim 12, wherein at least one of a bottom of the adjusting member and a bottom of the supporting member are operatively rotatably connected to the corresponding fifth rod.

17. A hammock comprising a frame, the frame being movable between an expanded configuration and a folded configuration, the frame comprising:

two sets of connecting rod assemblies located on opposite lateral sides of the frame and connected to each other, each connecting rod assembly comprising a first rod, a second rod, a third rod, a fourth rod, a fifth rod, and a sixth rod, wherein in each connecting rod assembly:

a top of the first rod is rotatably connected with a top of the second rod, a bottom of the third rod is rotatably connected with a bottom of the fourth rod, the first rod is rotatably connected with the third rod, the second rod is rotatably connected with the fourth rod, a connection of the top of the first rod with the top of the second rod is located above a connection of the bottom of the third rod with the bottom of the fourth rod;

a bottom of the first rod is operatively rotatably connected with a bottom of the fifth rod, a bottom of the second rod is operatively rotatably connected with a bottom of the sixth rod;

a first connecting rod has one end operatively rotatably connected to the fifth rod and another end operatively rotatably connected to a top of the third rod;

a second connecting rod has one end operatively rotatably connected with a sixth rod and another end operatively rotatably connected to a top of the fourth rod; and a positioning groove is arranged on at least one of the fifth rod of each connecting rod assembly and the sixth rod of each connecting rod assembly, wherein when the positioning groove is arranged on the fifth rod of each connecting rod assembly, the first connecting rod is releasably engageable in the respective positioning groove; and wherein when the positioning groove is arranged on the sixth rod of each connecting rod assembly, the second connecting rod is releasably engageable in the respective positioning groove.

* * * * *